United States Patent [19]

Hively

[11] 4,037,629

[45] July 26, 1977

[54] PORTABLE CRIMPING DEVICE

[76] Inventor: Vern J. Hively, 3640 Mountview Drive, Alliance, Ohio 44601

[21] Appl. No.: 747,690

[22] Filed: Dec. 6, 1976

[51] Int. Cl.[2] ..... B21D 13/04

[52] U.S. Cl. ..... 140/106; 72/196; 72/211

[58] Field of Search ..... 140/106; 113/58; 72/196, 211; 226/181, 191, 194

[56] References Cited

U.S. PATENT DOCUMENTS

| | | | |
|---|---|---|---|
| 689,449 | 12/1901 | Zimmerman | 140/106 |
| 1,322,109 | 11/1919 | Hahnemann | 72/211 |
| 1,801,311 | 4/1931 | Johnson | 72/196 |
| 2,471,445 | 5/1949 | Nicholas | 72/211 |

FOREIGN PATENT DOCUMENTS

| | | | |
|---|---|---|---|
| 5,343 | 12/1931 | Australia | 140/106 |

*Primary Examiner*—Lowell A. Larson
*Attorney, Agent, or Firm*—Frease & Bishop

[57] ABSTRACT

A device primarily for use by silversmiths and hobbyists for crimping a relatively thin strip of metal for jewelry creations and crafts. A pair of discs each have a centrally mounted pinion gear extending outwardly from a flat face of the disc. The gears are received within an annular collar having an elliptical cross-sectional configuration which houses the gears in meshing relationship and separates the discs. A pair of aligned holes is formed in the collar for receiving and discharging a strip of metal which is fed between the meshing gears and crimped when the discs are manually rotated. The collar is adjustable to regulate the crimp depth by varying the elongation of the collar by mechanically pressure squeezing the same.

8 Claims, 9 Drawing Figures

PORTABLE CRIMPING DEVICE

BACKGROUND OF THE INVENTION

1. Field of the Invention

The invention relates to a precision device for use by silversmiths and hobbyists, and particularly to a portable tool for crimping a metal strip. More particularly, the invention relates to an extremely simple and portable device having a pair of hand rotated knobs with meshing gears between which a metal strip is fed for decoratively crimping the strip.

2. Description of the Prior Art

Numerous devices have been devised for forming crimps or corrugations in metal strips for a variety of uses by passing the strip material between meshing gears, whereupon the gear teeth form the alternating series of waves and grooves in the metal. Most of these devices are large, bulky equipment having handcrank or motor-operated gears, requiring the equipment to be mounted on a workbench or another piece of equipment. Such equipment is relatively expensive to the amateur silversmith or part time hobbyist.

A variety of uses have been found by silversmiths and hobbyists for crimped relatively narrow strips of thin gauge metal, such as silver, brass and copper, generally in the range of 30 to 24 gauge, for various jewelry creations and crafts. Such zig-zag or sawtooth design strips are used to form an attractive trim for rings, pendants, bolo ties, etc.

Thus, the need has developed for a relatively inexpensive crimping tool for use by amateur silversmiths and hobbyists for creating such attractive, professional appearing crimped strips for use in their creations, not attainable by large industrial-type crimping devices. Furthermore, most known crimping devices do not provide means for easily adjusting the depth of the crimp formed by the meshing gears or to permit various metal thicknesses and corresponding crimp depths to be used and achieved.

SUMMARY OF THE INVENTION

Objectives of the invention include providing a portable crimping device which is of an extremely simple and rugged configuration to enable silversmiths and hobbyists to create attractive, professional appearing zig-zag and sawtooth designs in strips of relatively thin gauge sheet metal for trimming rings, pendants, etc., in the creation of jewelry and crafts; providing such a device which enables only a predetermined length or portions of a strip to have the crimp formed therein, with other portions of the metal strip remaining flat and uncrimped; providing such a device which is compact and lightweight, easily transported and stored, and which can be used by an inexperienced hobbyist or metal worker; providing such a device which is comprised of a relatively few component parts, which parts are formed from readily available materials, thereby eliminating expensive machining or forming processes to construct the same, and enabling the device to be produced and maintained inexpensively; providing such a device which can be adjusted easily without requiring additional component parts to vary the crimp depth and to crimp metal strips of various gauge thicknesses, thereby providing a relatively wide range of usage for the silversmiths and hobbyists; and providing such a crimping device which is simple and durable in use, and which eliminates difficulties heretofore encountered with prior crimping devices, achieves the objectives indicated and solves problems and satisfies needs existing in the art.

These objectives and advantages are obtained by the portable device of the invention for use in crimping a metal strip, the general nature of which may be stated as including a pair of spaced knob means; gear means mounted on each knob means and extending outwardly therefrom, with said gear means being in meshing engagement with each other upon rotation of at least one of the knob means; collar means located between the knob means and surrounding the meshing gear means; and opening means formed in the collar means for inserting and discharging a metal strip which is crimped by the meshing gears when passing between said gear means upon rotation of said knob means.

BRIEF DESCRIPTION OF THE DRAWING

A preferred embodiment of the invention — illustrative of the best mode in which applicant has contemplated applying the principle — is set forth in the following description and shown in the accompanying drawing, and is particularly and distinctly pointed out and set forth in the appended claims.

Similar numerals refer to similar parts throughout the drawings.

DESCRIPTION OF THE PREFERRED EMBODIMENT

Figure 1:
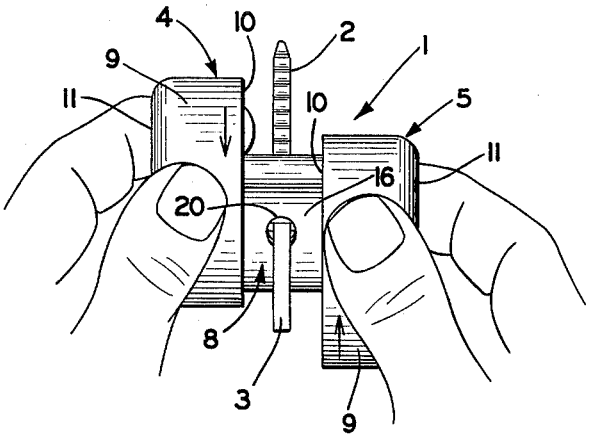
FIG. 1 is a perspective view of the portable crimping device of the invention in operation, crimping a strip of metal.
Figure 3:
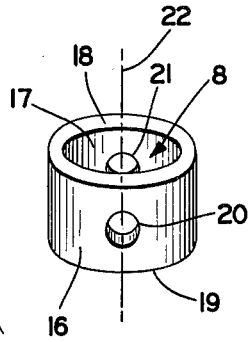
FIG. 3 is a perspective view of the elongated gear housing collar component of the crimping device.

The portable crimping device of the invention is indicated generally at 1, and is shown particularly in FIG. 1, being manually operated to form a crimping configuration 2 in a metal strip 3. Device 1 includes a pair of knobs 4 and 5 (FIG. 5) with centrally mounted gears 6 and 7, respectively, and a gear housing collar 8. One of the advantages of the invention is the identical configurations of knobs 4 and 5 and their associated gears 6 and 7, thereby eliminating right and left-hand components, and permitting interchangeability of the various components thereof. Due to this similarity of parts, only knob 4 and its associated gear 6 are shown in detail in FIG. 2.

Figure 2:
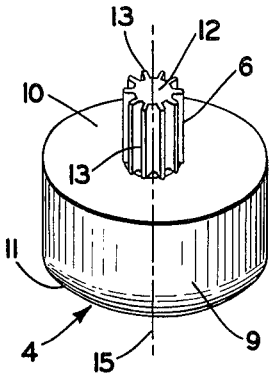
FIG. 2 is a perspective view of one of the knob and gear assemblies, a pair of which forms the main components of the crimping device.

Knobs 4 and 5 preferably have disc-like configurations formed by cylindrical side walls 9 and parallel, inner and outer planar end faces 10 and 11, respectively (FIG. 2). Knobs 4 and 5 preferably are formed of wood, although the same may be molded of plastic, metal or other material, if desired.

Figure 5:
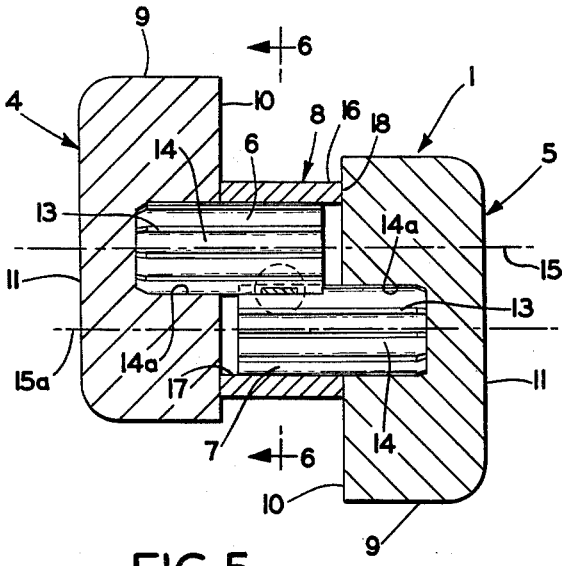
FIG. 5 is a sectional view taken on line 5—5, FIG. 4.

Gears 6 and 7 preferably are formed of short sections of pinion gear wire having a solid central core portion 12 with a plurality of gear teeth 13. Teeth 13 extend radially outwardly from core 12 in a usual spur gear configuration and extend parallel to the axis of rotation of the gear. The inner ends 14 of the gears are slightly tapered and are embedded by a force fit in holes 14*a* drilled in knobs 4 and 5 (FIG. 5). Gears 6 and 7 are located at the center point or axes 15 and 15*a* of the knobs so as to be concentric with cylindrical side walls 9. Gears 6 and 7 also extend outwardly from inner faces 10 of knobs 4 and 5 and have their axes perpendicular thereto.

Figure 6:
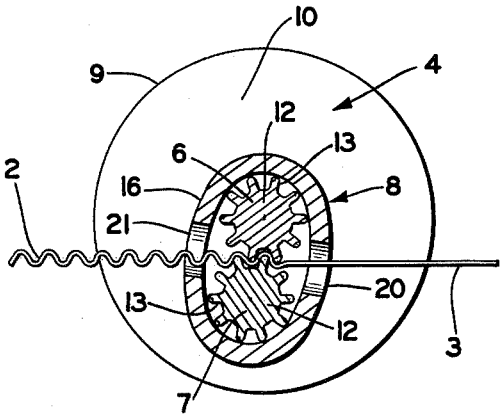
FIG. 6 is a sectional view taken on line 6—6, FIG. 5.

Housing collar 8 has a slightly elongated shape with a generally elliptical cross-sectional configuration (FIG. 6). Collar 8 has annular outer and inner surfaces 16 and 17 and planar, elliptical end faces 18 and 19. A pair of aligned holes 20 and 21 are formed in collar 8 and have their center points lying on an imaginary line 22 extending through the minor axis of the ellipse formed by the elongated housing configuration.

Figure 7:
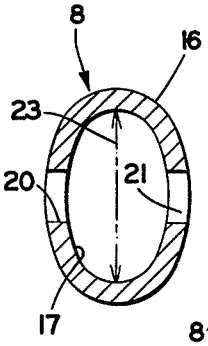
FIG. 7 is a sectional view of the gear housing collar of FIG. 3.

The internal major axis 23 (FIG. 7) of collar 8 will have a maximum dimension less than the total diameters of gears 6 and 7 (including teeth 13), and greater than the total diameters of the solid central portions 12 of the gears plus twice the length of gear teeth 13. These dimensions will insure that the gear teeth 13 will be in meshing engagement with each other, with the depth of engagement determining the depth of crimp in strip 3.

Figure 4:
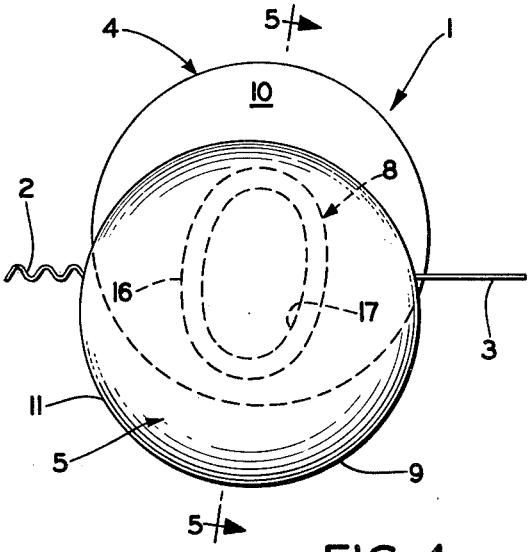
FIG. 4 is an enlarged side elevational view of the crimping device of FIG. 1 with a piece of metal being crimped.

In the assembled operating position (shown particularly in FIGS. 4, 5 and 6) gears 6 and 7 are placed in meshing engagement with respect to each other, telescopically mounted within collar 8. Collar 8 maintains separation between the inner faces 10 of knobs 4 and 5, with collar end faces 18 and 19 being in generally sliding engagement with the smooth circular end faces 10 of the knobs. The inner curved areas of surface 17 of collar 8, adjacent the elongated ends, function as bearing surfaces for gear teeth 13 upon rotation of knobs 4 and 5 (FIG. 6). Preferably, the longitudinal axial length of annular surfaces 16 and 17 of collar 8 is greater than the exposed length of gears 6 and 7 to prevent the outer ends of the gears from contacting inner faces 10 of knobs 4 and 5, as shown in FIG. 5. Axial center lines 15 and 15*a* of the gear and knob assemblies are in a spaced, parallel relationship with respect to each other, as shown in FIG. 5, whereby knobs 4 and 5 are rotatably mounted, eccentrically with respect to each other (FIG. 4) so that turning of either or both knobs rotatably meshes gears 6 and 7 with collar 8 remaining stationary.

In operation, a flat strip of metal 3 is inserted through either hole 20 or 21 of collar 8 and fed between gears 6 and 7. Rotation of either or both of the knobs 4-5 advances strip 3 between the gears, with gear teeth 13 forming crimps 2 therein. The crimped portion of the strip passes outwardly through the opposite collar hole upon continued rotation of the knobs until the entire strip of metal is crimped to a predetermined length thereof, as shown in FIG. 6. If only a portion of strip 3 is desired to be crimped, knobs 4 and 5 can be separated axially to disengage the meshed gears from the strip and from within collar 8, permitting the partially crimped strip to be removed without reversing or backfeeding the strip. If desired, a small amount of oil or other lubricant may be placed on gears 6-7 to facilitate their movement.

Figure 8:
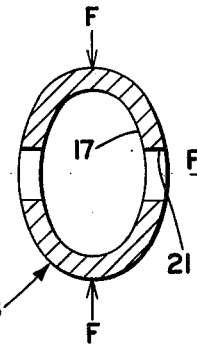
FIG. 8 is a view similar to FIG. 7, showing the collar being compressed to shorten the elongation thereof to form a deeper crimp in a strip of metal.
Figure 9:
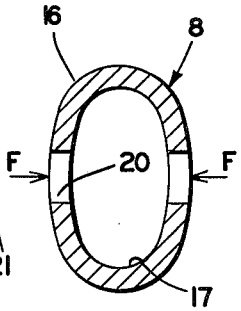
FIG. 9 is a view similar to FIGS. 7 and 8, showing the collar being elongated to form a more shallow crimp in a metal strip.

One of the important features of crimping device 1 is the ability to provide adjustment for varying the depths of the crimp formed in the metal strip and to accommodate strips of various thicknesses. This adjustment feature is shown in slightly exaggerated conditions in FIGS. 7, 8 and 9. A deeper crimp is achieved in the same thickness metal strip by shortening the major axis 23 of collar 8, as shown in FIG. 8 by applying an external squeezing force "F" thereto. This shortening of major axis 23 provides a deeper meshing engagement of the gear teeth 13 by decreasing the distance between the center lines of the gear and knob assemblies. Thus, the deeper meshing between the gear teeth forms a deeper crimp in the metal strip passed therebetween. A more shallow crimp is achieved by lengthening major axis 23 of collar 8, as shown in FIG. 9, by applying squeezing force "F" to the sides thereof in alignment with the minor axis of the ellipse. This lengthening of the major axis increases the separation between the major axes 15 and 15*a* (FIG. 5) reducing the meshing depth between gear teeth 13, thereby decreasing the depth of the crimping action imparted by the meshing teeth. Such adjustment also can be achieved by providing several collar sizes, although preferably it is achieved by squeezing collar 8 in the desired direction in a vice or other pressure-applying device, permitting the same collar to be used for any desired crimping depth or strip thicknesses. The amount of shortening and lengthening of the collar is extremely small since the metal strips used with device 1 usually are 24 to 30 gauge sheet metal. Although device 1 is described above as being used for crimping metal strip material, it also may be used for crimping lightweight wire, generally in the range up to 24 gauge, equally satisfactorily.

Portable crimp device 1 has a number of advantageous features. The device is formed of a relatively few components (knobs 4-5, gears 6-7, and collar 8), which components are readily available for purchase or easily formed, and therefore, they do not require expensive machining or manufacturing procedures to produce. For example, collar 8 may be formed of a standard size iron pipe which is cut into short sections and then squeezed to provide the desired major axis length 23, with holes 20 and 21 being drilled subsequently therein. The size of such pipe is determined by the size of pinion gears 6 and 7, which gears also may be formed by short sections of pinion wire. Knobs 4 and 5 may be formed of readily available hard wood, metal, etc.

Another advantage of device 1 is its extreme portability, lightweight, and ease of operation by an operator, as shown in FIG. 1. A further advantage is the adjustability of collar 8 to permit various depths of crimps to be formed and to permit various gauge thicknesses of sheet silver, brass, copper and like metals to be used therewith. Likewise, the ability of both knobs to be turned in opposite directions instead of requiring rotation of only one knob for operation of device 1, enables 50% less power or force to be used by each hand of the operator. Also, when both knobs are rotated simultaneously, the metal collar remains relatively stationary and the crimp strip is fed outwardly through its exit hole in a straight line fashion. An operator, if crimping a considerable number of short strips or lightweight wire, may clamp one of the knobs in a vice or other retaining device, enabling one hand to be used for rotating the free knob, with the other hand being used to manipulate the strips through the collar openings.

Accordingly, the portable crimping device of the invention provides an extremely simple and durable structure, the arrangements and components of which are very simple to manufacture and use, which eliminates difficulties in the art, and which achieves the stated objectives and solves problems which have existed in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the portable crimping device is constructed and used, the characteristics of the construction, and the advantageous, new and useful results obtained; the new and useful structures, devices, elements, arrangements, parts, and combinations, are set forth in the appended claims.

I claim:

1. A portable device for crimping a metal strip including:

a. a pair of spaced knob means;

b. gear means mounted on each knob means and extending outwardly therefrom, with said gear means being in meshing engagement with each other upon rotation of at least one of the knob means;

c. collar means located between the knob means and surrounding the meshing gear means;

d. opening means formed in the collar means for inserting and discharging a metal strip which is crimped by the meshing gear means when fed between said gear means upon rotation of said knob means.

2. The device defined in claim 1 in which each of the knob means includes at least one planar end face, with said end faces being in spaced opposed relationship to each other; in which each of the gear means is a spur gear having a plurality of straight teeth extending parallel to the axis of rotation of said gear; and in which the spur gears extend perpendicular with respect to their respective planar end face.

3. The device defined in claim 2 in which the axes of rotation of the spur gears are in a spaced parallel relationship with respect to each other.

4. The device defined in claim 2 in which each knob means of the pair is identical with respect to each other; and in which each of the knob means includes a pair of planar end faces and a cylindrical side surface extending therebetween, forming a disc-like configuration.

5. The device defined in claim 1 in which the gear means each includes a spur gear having first and second ends; in which the first ends are embedded in their respective knob means; and in which the second ends are formed with a plurality of straight teeth extending parallel to the axis of rotation of the spur gears.

6. The device defined in claim 1 in which the collar means has an elongated shape with an elliptical cross-sectional configuration having major and minor axes; and in which the opening means includes a pair of spaced holes aligned with and located at the ends of the minor axis.

7. The device defined in claim 6 in which the collar means is an annular band of material having inner and outer annular surfaces terminating in spaced planar end faces, with said end faces having elliptical configurations.

8. The device defined in claim 1 in which the collar means has an annular configuration with an elliptical cross-sectional configuration and major and minor axes; and in which said collar means is adjustable to vary the depth of crimp in a metal strip by changing the lengths of the axes.

* * * * *